US005813370A

United States Patent [19]

Owen et al.

[11] Patent Number: 5,813,370

[45] Date of Patent: Sep. 29, 1998

[54] STEAM GENERATOR LANCING SYSTEM

[75] Inventors: George V. Owen, Forest, Va.; Scott M. Theiss, Lake Lure, N.C.

[73] Assignee: Franatome Technologies Inc., Lynchburg, Va.

[21] Appl. No.: 535,570

[22] Filed: Sep. 28, 1995

[51] Int. Cl.[6] ..... F22B 37/48; F28G 9/00

[52] U.S. Cl. ..... 122/382; 122/391; 122/392; 15/316 R; 134/172

[58] Field of Search ..... 122/381, 382, 122/391, 392; 165/95; 15/316 R; 134/167 C, 172, 168 C

[56] References Cited

U.S. PATENT DOCUMENTS

| | | | |
|---|---|---|---|
| 4,079,701 | 3/1978 | Hickman et al. | 122/382 |
| 4,424,769 | 1/1984 | Charamathieu et al. | 122/392 |
| 4,515,747 | 5/1985 | Creek et al. | 376/249 |
| 4,566,406 | 1/1986 | Appleman | 122/405 |
| 4,676,201 | 6/1987 | Lahoda et al. | 122/382 |
| 4,700,662 | 10/1987 | Fasnacht, Jr. et al. | 122/392 |
| 4,715,324 | 12/1987 | Muller et al. | 122/382 |
| 4,757,785 | 7/1988 | Klahn et al. | 122/382 |
| 4,887,555 | 12/1989 | Smet | 122/382 |
| 5,036,871 | 8/1991 | Ruggieri et al. | 134/167 R |
| 5,069,172 | 12/1991 | Shirey et al. | 122/382 |
| 5,320,072 | 6/1994 | Theiss et al. | 122/382 |
| 5,570,660 | 11/1996 | Vandenberg | 122/382 |

*Primary Examiner*—Henry A. Bennett
*Assistant Examiner*—Gregory Wilson
*Attorney, Agent, or Firm*—Rhodes Coats & Bennett, L.L.P.

[57] ABSTRACT

A steam generator lancing system for cleaning tubes and tubesheets of a steam generator. The lancing system includes a nozzle block including at least one nozzle adapted for fluid communication with a high pressure hose. The lancing system also includes a support assembly including a carrier for transporting the nozzle block through the steam generator and a control system operative to selectively position the nozzle with respect to the tubes and tubesheets in the steam generator. Finally, in the preferred embodiment, the lancing system includes a rocker assembly operable to rotate the nozzle about a rocker axis to improve cleaning efficiency.

17 Claims, 6 Drawing Sheets

FIG. 2
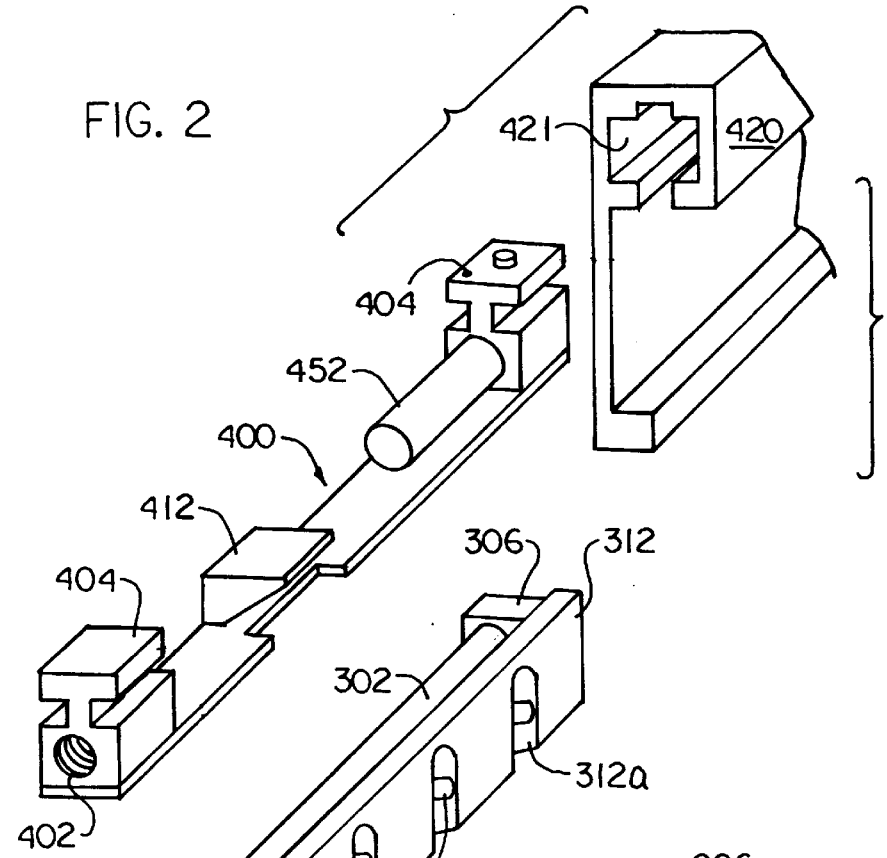
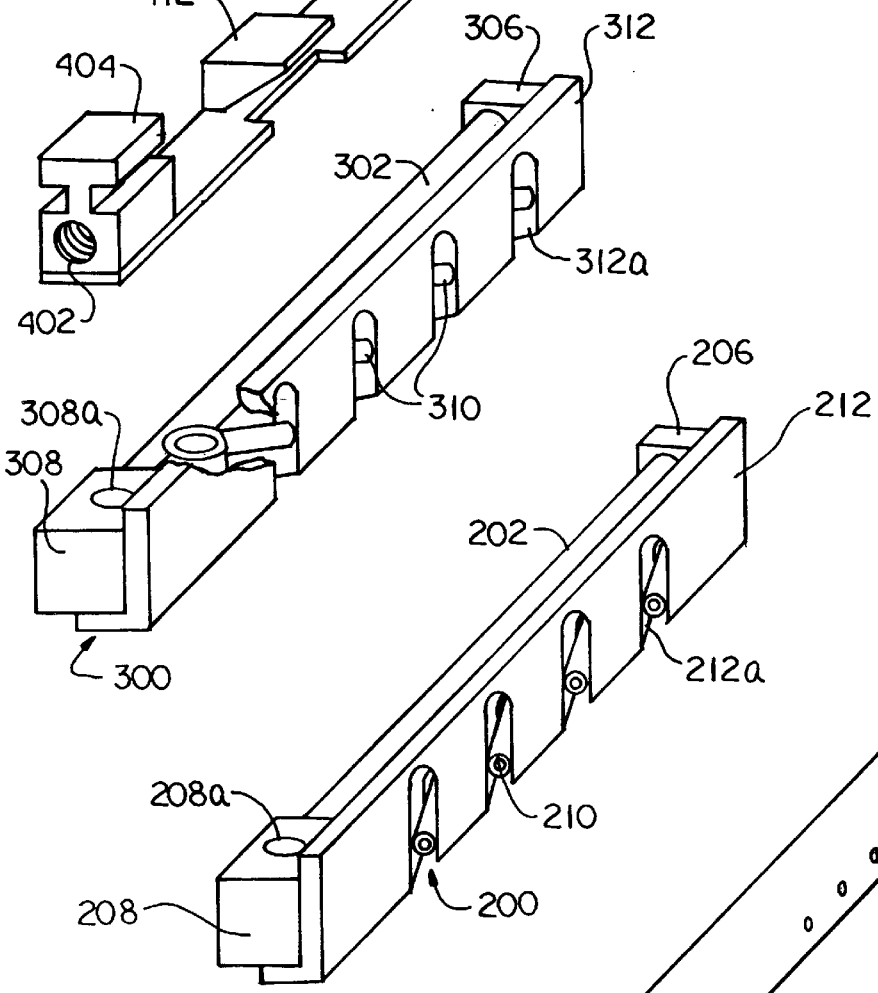
FIG. 3
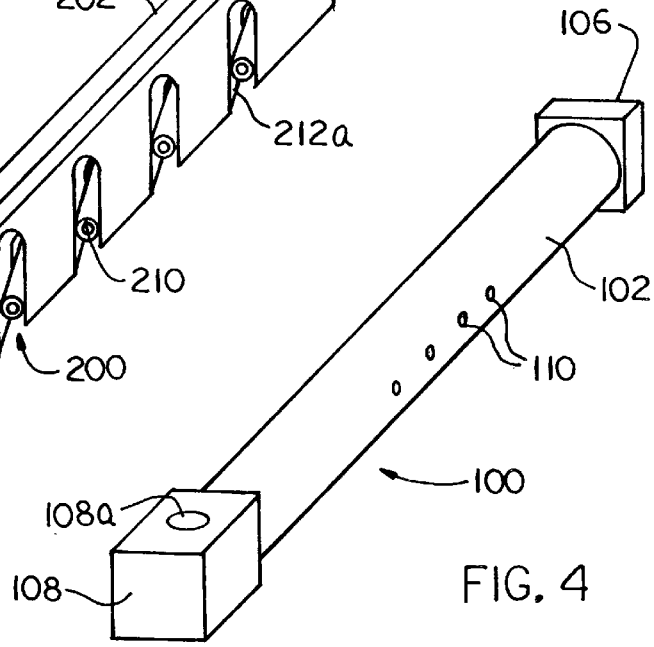
FIG. 4

STEAM GENERATOR LANCING SYSTEM

BACKGROUND OF THE INVENTION (1) Field of the Invention

The present invention relates generally to equipment for cleaning steam generators and, more particularly, to a high pressure fluid lancing system for cleaning sludge off of the tubesheets and tubes of the steam generators.

(2) Description of the Prior Art

In nuclear power stations, steam generators are used to exchange heat from the primary side to the secondary side in order to generate steam for driving turbines. Primary fluid which is heated by the core of the nuclear reactor is forced through a collection or bundle of tubes in the steam generator. A secondary fluid, generally water, is fed into the space around the tubes, thereby providing a continuous steam generation cycle. Because of the constant high temperature and severe operating environment, a sludge mainly comprised of iron oxides, such as magnetite, builds up on the lower outer portion of the tubes and on the tubesheets that support the tube bundle. Because the sludge build up on the tube bundle and tubesheets reduces heat transfer efficiency and can cause corrosion, it is preferable that the tubes and tubesheets be cleaned periodically to remove the sludge.

Conventional sludge lancing consists of the use of segmented lances, usually connected together by threads, that are moved into and out of the tube bundle by an externally mounted indexer. Operation of these lances requires that the lance sections be removed or added as the lances are retracted or advanced. The addition or removal of lance sections requires that the sludge lancing operation be stopped and further requires the presence of personnel in a radioactive area. Depending on the job and the number of passes required with the lance, as much as one half of the time scheduled for the operation involves adding and removing lance sections. This results in increased radiation exposure of personnel and unproductive down time of the nuclear steam supply system.

U.S. Pat. No. 4,079,701 discloses a system for removing sludge from a steam generator wherein headers are arranged at the elevation of the sludge to be removed and a fluid lance is moved along the line between the headers.

U.S. Pat. No. 4,424,769 discloses an apparatus for the removal of sludge deposits on the tubesheet of a steam generator wherein a lance assembly is moved into and through the steam generator by a driving mechanism. Cleaning is carried out in successive sequences with different lances that direct cleaning fluid to the tube plate in different zones more and more remote from the lances.

U.S. Pat. No. 4,515,747 discloses a wheeled transporter that is pulled by cables along the tubesheet between the tube bundle and the steam generator shell. Inspection equipment or a nozzle for cleaning the tubesheet may be attached to the transporter.

U.S. Pat. No. 4,566,406 discloses a steam generator having a manifold with a plurality of nozzles for cleaning sludge from the tubesheet. The manifold is rigidly attached to the tubesheet and remains in place during normal operation of the steam generator.

U.S. Pat. No. 4,700,662 discloses a sludge lance wand for cleaning once through steam generators. A curved high pressure fluid feed tube has a plurality of feed tube extensions attached at one end and a nozzle brace attached at the other end. A second nozzle brace bolted to the first nozzle brace retains nozzle blocks in position between the two braces. Nozzle blocks are in fluid communication with the first nozzle brace and are provided with nozzle openings angled for cleaning the triangular pitch positioned tubes in a once through steam generator.

U.S. Pat. No. 4,757,785 discloses a steam generator sludge removal apparatus wherein a track is assembled between the once through steam generator outer shell and circular shroud around the tube bundle. A motorized carriage driven on the track directs high pressure fluid toward the tube bundle through windows in the circular shroud.

U.S. Pat. No. 5,320,072, issued to Theiss et al., discloses an apparatus for removing sludge from the tubes and tubesheet of a steam generator. A support structure is mounted on an access port of a steam generator and a lance tube extends from the support structure into the steam generator. A spool is attached to a high pressure hose received in the lance tube. A pinch roller assembly mounted on the support structure is used to move the cylinder through the lance tube. High pressure water flows through slots drilled in the spool and out holes in the lance tube against the tubes and tubesheet. A rocker motor causes back and forth rotation or rocking of the lance tube to create a sweeping action.

U.S. Pat. No. 5,069,172, issued to Shirey et al., discloses a typical "outside in" type of sludge removal system.

It is also known to use a cart equipped with a nozzle head which rides around the annulus of the steam generator vessel and sprays each tube length, washing the sludge toward the center where it is picked up by suctions. This methodology is conventionally termed "outside in" cleaning. The operator must manually control the linear motion of the cart as well as the rotational motion of the nozzle head to align the nozzles with the tube rows. This alignment must be verified each time by a camera in the no tube lane because the operator cannot visually determine if the nozzles' angle is correct. As the cart moves around the annulus, this angle changes. Often, the system operator must "hunt and peck" each time he indexes, both linearly and rotationally, until he sees water in the middle of the generator. This method is time consuming and dose intensive. Further, the method does not control the flow of sludge well. As a result, when the cart is being repositioned and aligned by the operator, sludge can migrate back into the area just cleaned.

Thus, there remains a need for a new and improved steam generator lancing system having the low exposure advantages of a track system while, at the same time, providing the cleaning efficiency of a conventional segmented lance having multiple cleaning heads.

SUMMARY OF THE INVENTION

The present invention is directed to a steam generator lancing system for cleaning tubes and tubesheets of a steam generator. The lancing system includes a nozzle block including at least one nozzle adapted for fluid communication with a high pressure hose. In the preferred embodiment, the nozzle block includes: a frame; a nozzle body mounted in the frame for rotation with respect to the frame about a rocker axis, the nozzle body including an inlet connectable with the high pressure hose for fluid communication therewith; and a nozzle mounted in the nozzle body, the nozzle in fluid communication with the inlet.

The lancing system also includes support means including a carrier for transporting the nozzle block through the steam generator and a control system operative to selectively position the nozzle with respect to the tubes and tubesheets in the steam generator.

The control system includes a chain secured to the carrier and indexer means including a computer operative to measure the length of the chain extended into the steam generator and to automatically position the nozzle block with respect to the tubes. The indexer includes an indexer motor; an indexer linkage means between the indexer motor and the chain; an encoder for generating a signal corresponding to a prescribed length of the chain extended into the steam generator.

Finally, in the preferred embodiment, the lancing system includes rocker means operable to rotate the nozzle about a rocker axis.

Accordingly, one aspect of the present invention is to provide a lancing system for cleaning tubes and tubesheets of a steam generator. The lancing system includes: (a) a nozzle block including at least one nozzle adapted for fluid communication with a high pressure hose; (b) support means including a carrier for transporting the nozzle block through the steam generator; and (c) a control system operative to selectively position the nozzle with respect to the tubes and tubesheets in the steam generator.

Another aspect of the present invention is to provide a nozzle block for use in a lancing system for cleaning tubes and tubesheets of a steam generator, the lancing system including a high pressure hose. The nozzle block includes: (a) a frame; (b) a nozzle body mounted in the frame for rotation with respect to the frame about a rocker axis, the nozzle body including an inlet connectable with the high pressure hose for fluid communication therewith; and (c) a nozzle mounted in the nozzle body, the nozzle in fluid communication with the inlet.

Still another aspect of the present invention is to provide a lancing system for cleaning tubes and tubesheets of a steam generator. The lancing system includes: (a) a nozzle block including at least one nozzle adapted for fluid communication with a high pressure hose, the nozzle block including: (i) a frame; (ii) a nozzle body mounted in the frame for rotation with respect to the frame about a rocker axis, the nozzle body including an inlet connectable with the high pressure hose for fluid communication therewith; and (iii) a nozzle mounted in the nozzle body, the nozzle in fluid communication with the inlet; (b) support means including a carrier for transporting the nozzle block through the steam generator; (c) a control system operative to selectively position the nozzle with respect to the tubes and tubesheets in the steam generator; and (d) rocker means operable to rotate the nozzle about a rocker axis.

These and other aspects of the present invention will become apparent to those skilled in the art after a reading of the following description of the preferred embodiment when considered with the drawings.

BRIEF DESCRIPTION OF THE DRAWINGS

FIG. 2 is an exploded, fragmentary, perspective view of a 150° nozzle block, a trolley, and a portion of a track, all forming a part of the lancing system according to the present invention;

FIG. 3 is a perspective view of a 30° nozzle block according to the present invention;

FIG. 4 is a perspective view of a 90° nozzle block;

DESCRIPTION OF THE PREFERRED EMBODIMENTS

Figure 1:
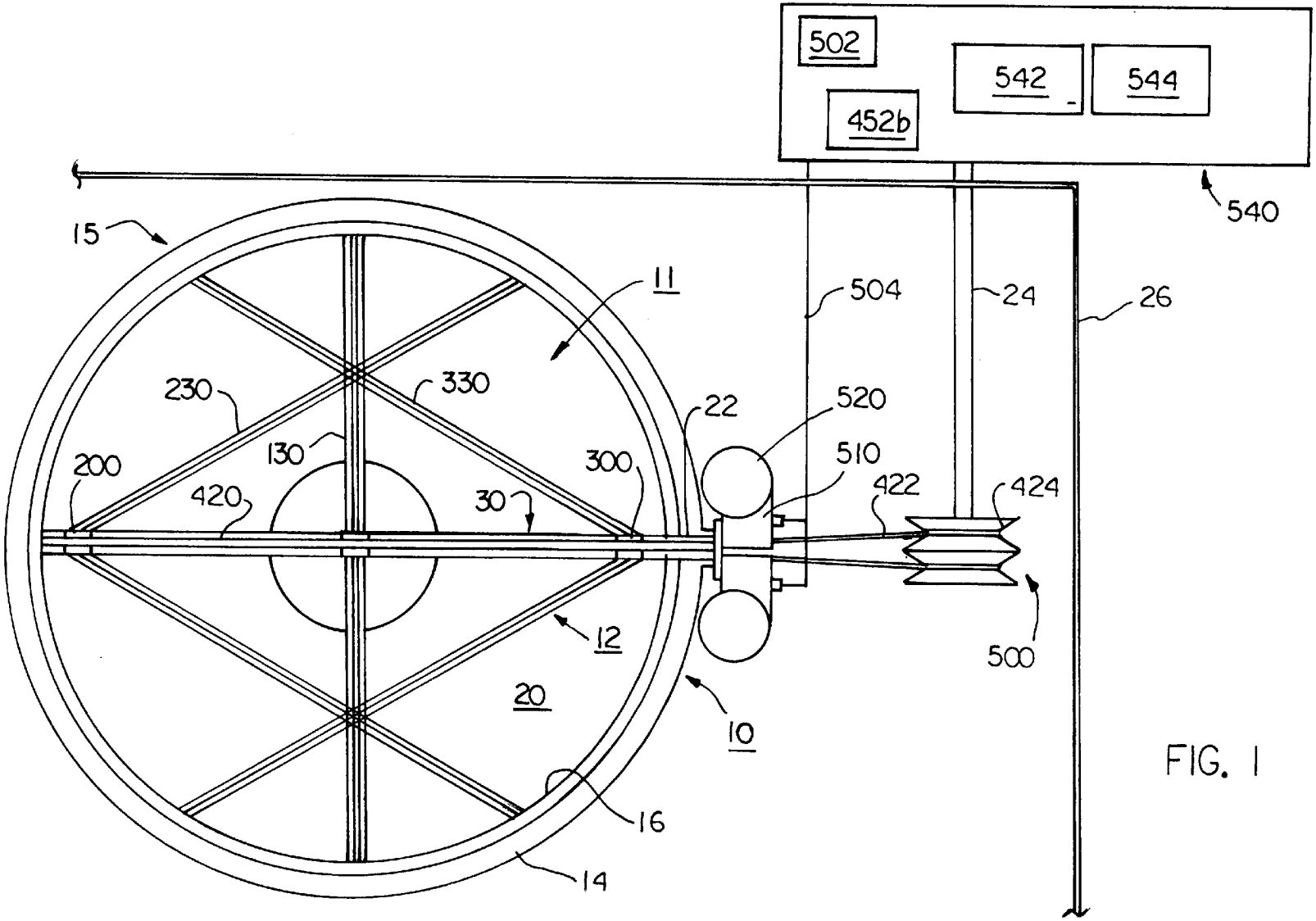
FIG. 1 is a schematic plan view of a lancing system constructed according to the present invention shown in conjunction with a steam generator.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a lancing system constructed according to the present invention, generally designated 10, is adapted to clean the tubes 20 and the tubesheets of a steam generator 15 using an "inside out" methodology. Selectively positioned fluid jets, described in greater detail below, are provided in the no tube lane 30 of the steam generator. The jets liberate sludge from the tubes and tubesheets and direct the same toward annulus 16 of the steam generator. The sludge may be removed from annulus 16 by any suitable means, such as, for example, by suctions (not shown).

Lancing system 10 includes in the preferred embodiment right assembly 11 and left assembly 12. Right and left assemblies 11,12 are mirror images of one another and only right assembly 11 will be discussed hereinafter, it being understood that the description of assembly 11 applies equally to left assembly 12.

Lancing system 10 includes track 420 which extends along no tube lane 30. Trolley 400 is positioned along track 420 by chain 506 and indexer 510. One of nozzle blocks 100,200,300 is mounted on trolley 400. The nozzle block includes a plurality of nozzles which direct high pressure fluid streams between respective rows of tubes 20 at a prescribed angle with respect to the length of the track. FIG. 1 shows the preferred angles of the respective jet streams 130, 230, 330 of nozzle blocks 100, 200, 300.

In practice, only one nozzle block would be mounted on each track at a time, and the three nozzle blocks are shown on each track for illustrative purposes only. The trolley is provided with a rocker assembly 450 which serves to rock or rotate the nozzles about an axis substantially parallel to the length of track 420. The rocking motion serves to direct the high pressure fluid streams up and down the length of the tubes and directly onto the tubesheets. In particular, this action serves to dislodge and evacuate sludge and deposits collected at the joinder of the tubes and tubesheets.

Track 420 is mounted, via a mounting bracket, to one or both hand holes 22 located on no tube lane 30 of steam generator 15. As shown in FIG. 2, track 420 includes lengthwise slot 421 extending therealong.

With further reference to FIG. 2, trolley 400 is mounted in track 420 by means of T-shaped slide mounts 404. Rollers facilitate movement of trolley 400 along track 420. Trolley 400 includes camera 412, conduit 402, and rocker air motor 452. Camera 412 can also be a proximity sensor. Conduit 402 is adapted to connect with high pressure hose 422 by means of coupling 406. Trolley 400 is joined to rigid chain 506 by coupling 410. Rigid pushing chain 506 is preferably contained in slot 421 of track 420.

Figure 2A:
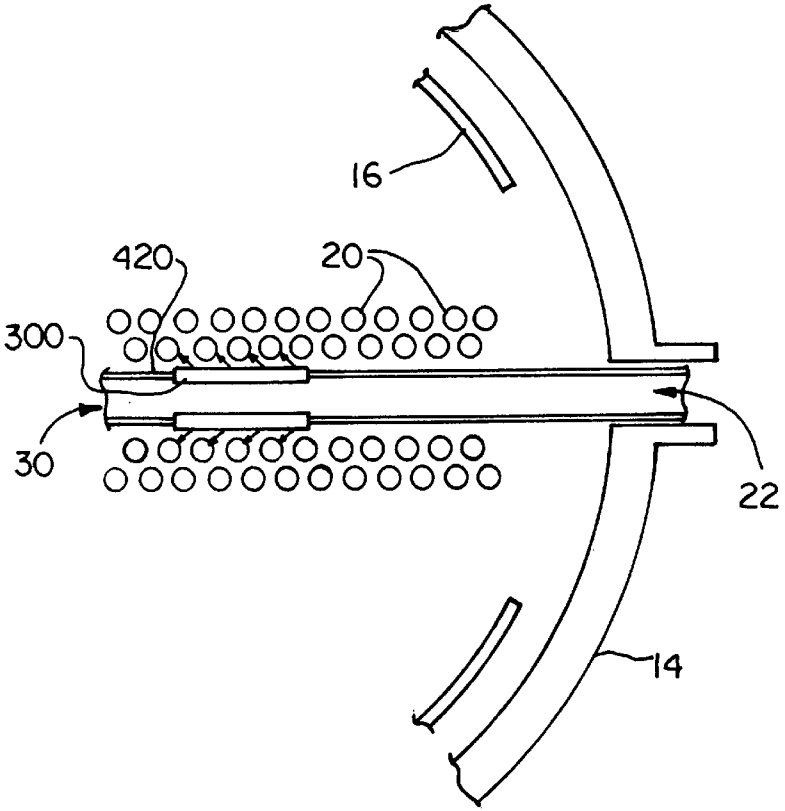
FIG. 2*a* is a schematic, fragmentary, plan view of the 150° nozzle block in the steam generator showing the direction of the fluid jet streams.

With reference to FIG. 1, nozzle block 300 is adapted to provide a fluid stream 330 consisting of four substantially parallel streams. Stream 330 is directed at an angle of about 150° with respect to track 420. The angle of the streams with respect to the tube lanes is shown in FIG. 2A.

Figure 5:
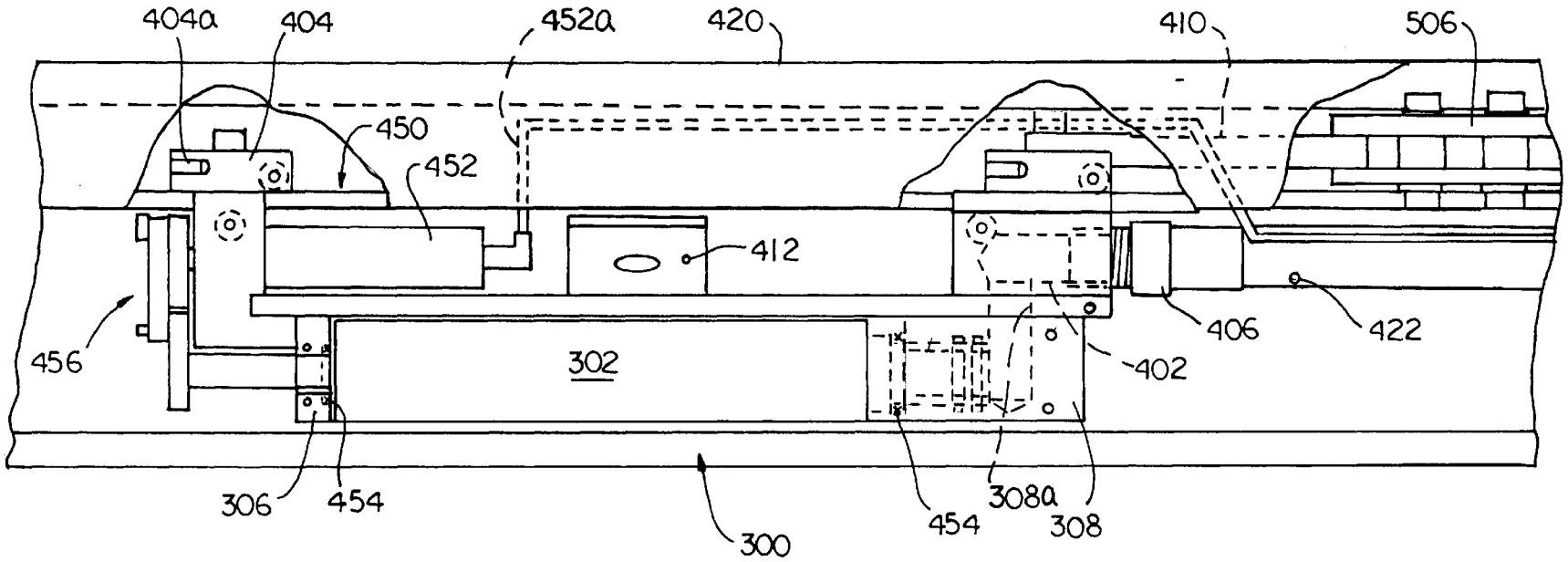
FIG. 5 is a side elevational view of the trolley, the nozzle block, and a portion of the track, each forming a part of the lancing system wherein the nozzle body of the nozzle block is shown schematically.

With reference to FIGS. 2 and 5, nozzle block 300 is shown in exploded view along with trolley 400. Nozzle block 300 includes front frame block 306 and rear frame block 308. Nozzle body 302 is mounted between frame blocks 306,308 by means of bearings 454 for rotation about an axis parallel to the length of track 420. A plurality of nozzles 310 are mounted in nozzle body 302 such that they may pivot in the plane defined by the lengths of tubes 20. When nozzle block 300 is secured to trolley 400, fluid from high pressure hose 422 flows through conduit 402, inlet 308*a*, and a conduit (not shown) formed through nozzle body 302 which communicates with each of nozzles 310. Accordingly, high pressure fluid provided by pump 544 through filter 542 (each located in trailer 540) ultimately exits at high velocity from each of nozzles 310. Guide 312 is secured to frame blocks 306,308 and includes guide slots 312*a* into which nozzles 310 are received. Guide slots 312*a* are aligned in parallel with the tubes of the steam generator.

With reference to FIGS. 1, 2, 5, and 5*a*, air motor 452 is powered by air provided under pressure through air conduit 452*a* and controlled by means of air solenoid valve 452*b*. When air motor 452 is actuated, the rotational force thereof is translated into oscillation of nozzle body 302 by means of linkage 456. Preferably, nozzle body 302 is rotated about bearings 454 through a range of about 80° such that the jet streams sweep the tubesheets and the lengths of the tubes. Notably, the provision of vertical guide slots 312*a* and the pivotable mounting of nozzles 310 on nozzle body 302 allows nozzles 310 to be rotated up and down about an axis parallel to the length of track 420, and, more particularly, about an axis perpendicular to the rocker axis. The ends of nozzles 310 ride in machined slots 312*a* in guide 312, thereby constraining their direction to the plane created by their respective tube lane.

Figure 3A:
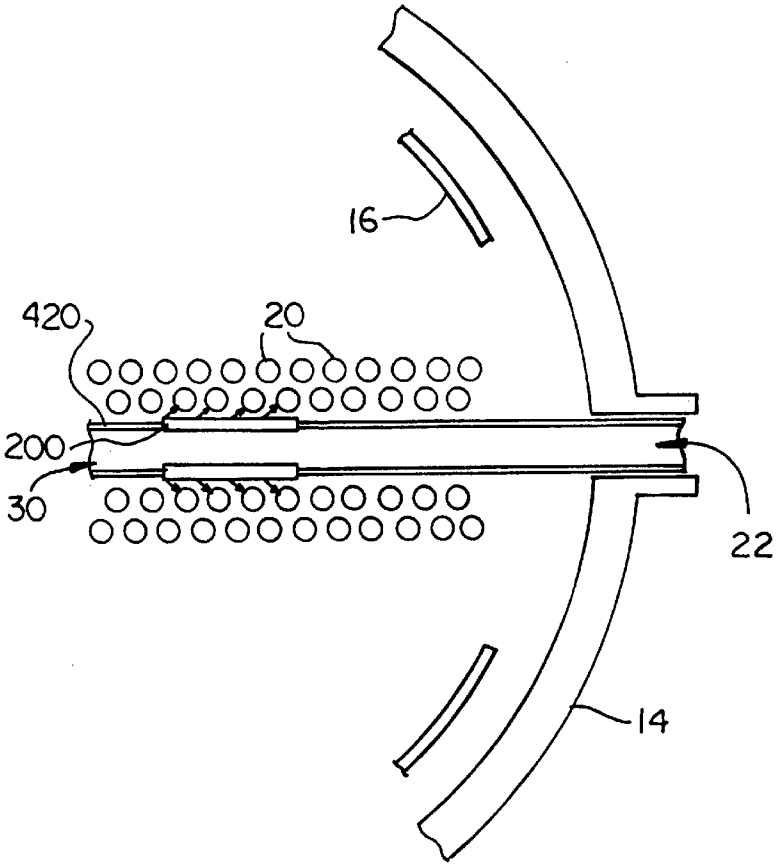
FIG. 3*a* is a schematic, fragmentary, plan view of the 30° nozzle block in the steam generator showing the direction of the fluid jet streams.

With reference to FIG. 3, nozzle block 200 is shown therein. Elements 202, 206, 208, 208*a*, 210, 212, and 212*a* correspond to elements 302, 306, 308, 308*a*, 310, 312, and 312*a* of nozzle block 300, respectively, except that nozzles 210 are positioned by guide slots 212*a* at an angle of approximately 30° with respect to track 420, thereby providing a jet stream 230 as shown in FIG. 1. The angle of the jet streams with respect to the tube lanes is shown in FIG. 3*a*.

Figure 4A:
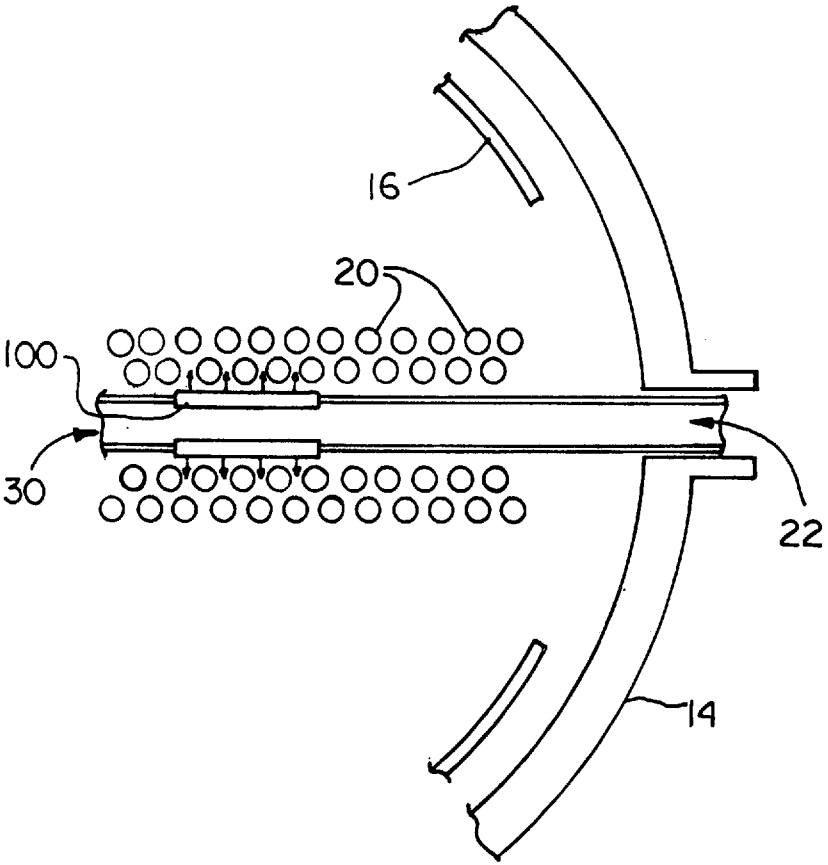
FIG. 4*a* is a schematic, fragmentary, plan view of the 90° nozzle block in the steam generator showing the direction of the fluid jet streams.

With reference to FIG. 4, nozzle block 100 is shown therein. Elements 102, 106, 108, and 108*a* correspond to elements 302, 306, 308, and 308*a* of nozzle block 300, respectively. Nozzle block 100 includes drilled nozzles 110 perpendicular to the rock axis. Nozzles 110 provide jet streams 130 as shown in FIG. 1. The angle of the streams with respect to the tube lanes is shown in FIG. 4A.

Preferably, trolley 400 and each of nozzle blocks 100, 200, 300 are cooperatively adapted such that each of the nozzle blocks may be selectively attached and detached from trolley 400, providing for interchangeability of the nozzle blocks. Thus, after trolley 400 is inserted into track 420, the three different nozzle blocks 100, 200, 300 may be interchanged without disconnecting any supply lines or linkages. In the preferred embodiment, the nozzle blocks and the trolley may be coupled by threaded fasteners constrained within the nozzle body.

Camera 412 monitors the water jets during operation and is used to initially align the jets with the tube rows.

Figure 6:
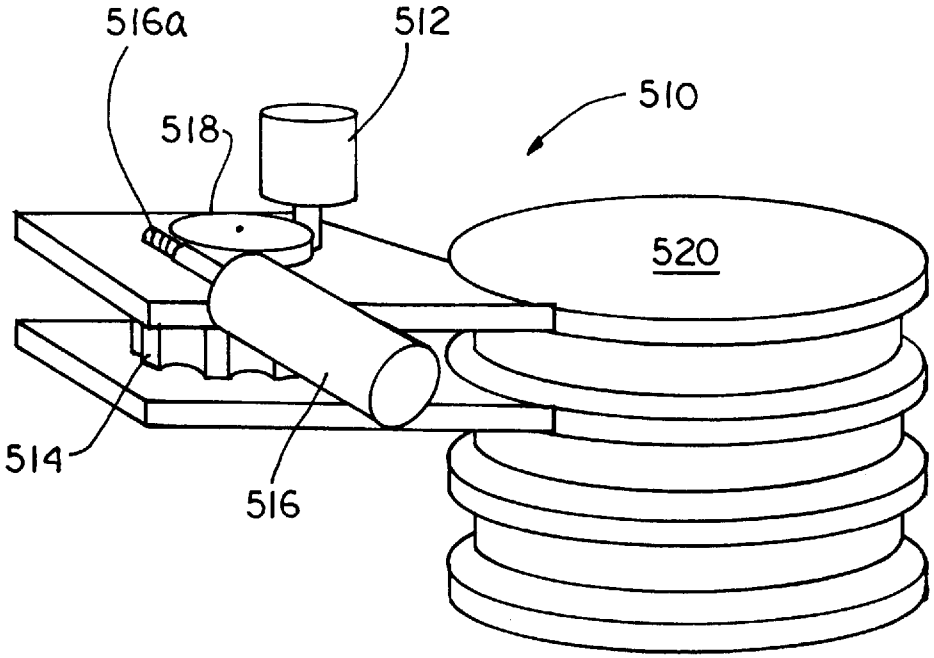
FIG. 6 is a perspective view of the indexer and chain storage canister of the lancing system.
Figure 5A:
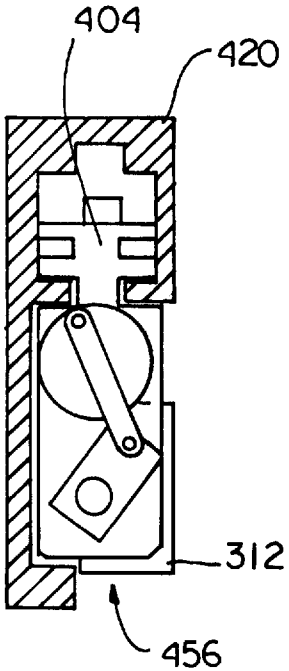
FIG. 5*a* is a front, end elevational view of the trolley and the 150° nozzle block.

With reference to FIGS. 1 and 6, indexer 510 and computer 502 serve to accurately position the nozzles with respect to the tube lanes. Indexer 510 utilizes electric motor 516, preferably a DC motor, to drive chain 506 (omitted from FIG. 6 for clarity) in and out of track 420 via sprocket 514. More particularly, control computer 502 controls the actuation and deactuation of electric motor 516, which in turn drives sprocket 514 via gears 516*a*, 518. Optical encoder 512 measures the rotation of sprocket 514 and sends the information to control computer 502 via control cable bundle 504. Control computer 502 calculates the position of trolley 400 inside steam generator 15. Once the operator aligns the nozzles in a first series of tube lanes using camera 412, control computer 502 automatically moves trolley 400 to the next lane for each index.

High pressure water, air, and video signal are fed to and received from the respective nozzle block through hose bundle 422. The excess chain is kept in chain storage canister 520 (mounted to indexer 510) where it stays until the nozzle block is pushed further into the steam generator. Hose reel 424, preferably spring loaded, stores hose bundle 422 until more hose is needed inside the generator. As the nozzle is retracted out of the generator, the excess chain is wound up on the canister, and the hose reel winds up the excess hose and cable thereby maintaining the hose bundle in constant tension. This eliminates the need for an attendant to be present during operation, therefore lowering radiation dose.

During operation, track 420 is mounted, via a mounting bracket, to one or both hand holes 22 located on no tube lane 30 of generator 15. High pressure water, supply air for rocker motor 452, and video lines are hooked to the appropriate nozzle block 100, 200, 300, then the trolley with the nozzle block is loaded into track 420. Rigid chain 506 next is connected to the trolley. Indexer 510 is then mounted to steam generator 15. From the safety of trailer 540 which is located externally of containment wall 26, the operator may turn rocker motor 452 on and off using air solenoid valve 452*b*, move the nozzle block through the generator, align the nozzles with the tube rows, supply high pressure water to the nozzles and monitor the lancing process using the onboard camera. Preferably, each of these operations may be conducted independently for each of right assembly 11 and left assembly 12.

Lancing system 10 washes from the inside out, constantly spraying in four rows, but only indexing one row at a time. This does not allow sludge to migrate back into the clean area because there are no long pauses in the indexing process. The operator linearly aligns the nozzles once, and observes the monitor each time the computer automatically indexes. Once the track is in place, and the alignment is set, the operator has to do very little to keep the system running. This results in a substantial reduction in the time required to lance the steam generator, and hence, a substantial reduction in the overall reactor downtime attributable to the cleaning process. Motor 452 rocks the nozzles approximately 80° which cleans the tubesheet in a sweeping motion, washing the sludge out to the generator's annulus where the suction pick-ups are located. The height and angle of the nozzles are permanently set according to the geometry of the generator itself.

Lancing system 10 provides several significant advantages. The provision of three different nozzle blocks 100, 200, 300 such that jet streams are directed at different angles with respect to the tube lanes, and the provision of the rocker function such that each nozzle rocks up and down approximately 80°, provide for three-directional lancing of the tubesheet. Because each nozzle block contains four nozzles, four adjacent tube rows may be washed at the same time. Moreover, where a left assembly and a right assembly are used in tandem, both the hot and the cold leg may be washed at the same time. After initial set up, an operator is needed at the generator only for quick nozzle changes, therefore lowering radiation dose.

The utilization of a rigid track to guide the nozzle and trolley through the generator provides certain advantages. The track resists nozzle reaction force and constrains nozzle motion to one direction. As a result, nozzle alignment is one-dimensional.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

Certain modifications and improvements will occur to those skilled in the art upon a reading of the foregoing description. By way of example, a cart containing nozzles could crawl along the no tube lane and lance the tubesheets. Alternatively, the nozzle block could be rigidly supported by a cantilever beam and inserted into the generator. The nozzle block would then be indexed and rocked by the beam, using an indexer located outside. As a further alternative, an in-bundle lancing technique could be used. Also, the chain could also be an endless toothed timing belt and pulley. It should be understood that all such modifications and improvements have been deleted herein for the sake of conciseness and readability but are properly within the scope of the following claims.

We claim:

1. A lancing system for cleaning tubes and tubesheets of a steam generator, said lancing system comprising:

(a) a nozzle block including at least one nozzle adapted for fluid communication with a high pressure hose, said nozzle block including:

(i) a frame; (ii) a rigid, one-piece nozzle body mounted in said frame for rotation with respect to said frame about a rocker axis, said nozzle body including an inlet connectable with the high pressure hose for fluid communication therewith; and (iii) a nozzle mounted in said nozzle body, said nozzle in fluid communication with said inlet, said nozzle block further including a guide having a slot formed therein for receiving said nozzle and maintaining said nozzle at a preselected angle of between about 30° and 150° with respect to said rocker axis;

(b) support means including a carrier for transporting said nozzle block through the steam generator;

(c) a control system connected to said nozzle block and operative to selectively position said nozzle with respect to the tubes and tubesheets in the steam generator; and (d) rocker means operable to rotate said nozzle about said rocker axis.

2. The apparatus according to claim 1 wherein said rocker axis is substantially parallel to the direction of transport of said nozzle block by said support means.

3. The apparatus according to claim 2 wherein said rocker includes:

(a) a rocker motor;

(b) control means for controlling the actuation and deactuation of said rocker motor; and (c) rocker linkage means between said nozzle block and said rocker motor.

4. The apparatus according to claim 3 wherein said rocker motor is an air motor and said control means includes an air valve.

5. The apparatus according to claim 1 wherein the range of rotation of said nozzle about said rocker axis is about 80°.

6. The apparatus according to claim 1 wherein said support means comprises a track extending through the steam generator and said carrier is a trolley mounted on said track for movement with respect thereto, and wherein said nozzle block is mounted on said trolley.

7. The apparatus according to claim 1 wherein said control system includes:

(a) a chain secured to said carrier; and (b) indexer means including a computer operative to measure the length of said chain extended into the steam generator and to automatically position said nozzle block with respect to the tubes.

8. The apparatus according to claim 7 wherein said indexer means includes:

(a) an indexer motor;

(b) indexer linkage means between said indexer motor and said chain;

(c) an encoder for generating a signal corresponding to a prescribed length of said chain extended into the steam generator; and (d) wherein said computer senses said signal and selectively actuates and deactuates said indexer motor responsive thereto.

9. The apparatus according to claim 1 wherein said nozzle body is selectively mountable on and demountable from said carrier.

10. The apparatus according to claim 1 wherein said control system includes a camera mounted on at least one of said nozzle block and said carrier.

11. The apparatus according to claim 1 wherein said nozzle is arranged and configured to direct fluid from the high pressure hose at an angle of about 90° with respect to said rocker axis.

12. The apparatus according to claim 11 wherein said nozzle comprises a hole formed in said nozzle body.

13. The apparatus according to claim 1 wherein said nozzle is arranged and configured to direct fluid from the high pressure hose at an angle of about 150° with respect to said rocker axis.

14. The apparatus according to claim 13 wherein said nozzle is pivotable about an axis perpendicular to said rocker axis.

15. The apparatus according to claim 1 wherein said nozzle is arranged and configured to direct fluid from the high pressure hose at an angle of about 30° with respect to said rocker axis.

16. The apparatus according to claim 15 wherein said nozzle is pivotable about an axis perpendicular to said rocker axis.

17. A method for cleaning tubes and tubesheets of a steam generator, said method comprising the steps of:

(a) supplying a fluid to a nozzle block including at least one nozzle adapted for fluid communication with a high pressure hose, said nozzle block including: (i) a frame; (ii) a rigid, one-piece nozzle body mounted in said frame for rotation with respect to said frame about a rocker axis, said nozzle body including an inlet connectable with the high pressure hose for fluid communication therewith; and (iii) a nozzle mounted in said nozzle body, said nozzle in fluid communication with said inlet, said nozzle block further including a guide having a slot formed therein for receiving said nozzle and maintaining said nozzle at a preselected angle of between about 30° and 150° with respect to said rocker axis;

(b) transporting said nozzle block through the steam generator on a support means including a carrier;

(c) selectively positioning said nozzle with respect to the tubes and tubesheets in the steam generator; and (d) rotating said nozzle about said rocker axis.

* * * * *

UNITED STATES PATENT AND TRADEMARK OFFICE

CERTIFICATE OF CORRECTION

PATENT NO. : 5,813,370

DATED : September 29, 1998

INVENTOR(S) : George V. Owen et al.

It is certified that error appears in the above—identified patent and that said Letters Patent is hereby corrected as shown below:

On the cover page of the patent, the correct spelling of the Assignee is "FRAMATOME TECHNOLOGIES, INC."

Signed and Sealed this

Fifteenth Day of December, 1998

Bruce Lehman

*Attest:*

BRUCE LEHMAN

*Attesting Officer*

*Commissioner of Patents and Trademarks*